US007230383B2

(12) United States Patent
Tsuda et al.

(10) Patent No.: US 7,230,383 B2
(45) Date of Patent: Jun. 12, 2007

(54) AUTOMOTIVE DISCHARGE BULB AND AUTOMOTIVE HEADLAMP

(75) Inventors: Toshiaki Tsuda, Shizuoka (JP); Masao Kinoshita, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 421 days.

(21) Appl. No.: 10/852,422

(22) Filed: May 25, 2004

(65) Prior Publication Data

US 2005/0007020 A1 Jan. 13, 2005

(30) Foreign Application Priority Data

Jun. 5, 2003 (JP) ..... 2003-161016

(51) Int. Cl.
*H01J 17/16* (2006.01)
*H01J 61/30* (2006.01)

(52) U.S. Cl. ..... 313/634; 313/573

(58) Field of Classification Search ..... 313/634
See application file for complete search history.

(56) References Cited

U.S. PATENT DOCUMENTS 3,885,181 A * 5/1975 Nelson et al. ..... 313/634
4,001,623 A * 1/1977 Howles et al. ..... 313/634
2005/0184640 A1* 8/2005 Yamashita et al. ..... 313/493

FOREIGN PATENT DOCUMENTS

JP 75034870 B * 11/1975
JP 2001-76677 A 3/2001

* cited by examiner

*Primary Examiner*—Mariceli Santiago
(74) *Attorney, Agent, or Firm*—Sughrue Mion, PLLC

(57) ABSTRACT

An automotive discharge bulb having a light emitting tube includes a ceramic tube with paired electrodes oppositely placed, and contains a light emitting material and starting rare gas. A transversal section of the ceramic tube is longitudinally elongated. In the ceramic tube having a longitudinally elongated transversal section, an arc generated into an upwardly convex shape and the tube wall do not make contact.

4 Claims, 10 Drawing Sheets

AUTOMOTIVE DISCHARGE BULB AND AUTOMOTIVE HEADLAMP

This application claims foreign priority based on Japanese patent application JP 2003-161016, filed on Jun. 5, 2003, the contents of which is incorporated herein by reference in its entirety.

BACKGROUND OF THE INVENTION

1. Field of the Invention

The present invention relates to an automotive discharge bulb having a light emitting tube that includes a ceramic tube in which electrodes are oppositely placed. The light emitting tube is filled with a light emitting material and a starting rare gas. The present invention further relates to an automotive headlamp having the discharge bulb.

2. Description of the Related Art

Generally, a discharge bulb having a glass arc tube is used as a light source for an automotive headlamp. However, the related art discharge bulb has encountered problems. For example, but not by way of limitation, metal halide filled in the light emitting tube promotes corrosion of the light emitting tube (or glass tube). Further, blackening and devitrification phenomena occur. Thus, no appropriate light distribution is obtained, and the life of the discharge bulb is not very long.

Recently, there has been proposed a related art discharge bulb (see FIG. 18) having a light emitting tube 110 that includes a right-circular-cylindrical ceramic tube 120, of which both ends are sealed with cylindrical insulating elements 130, and in which electrodes 140, 140 are oppositely placed, and that is filled with a light emitting material together with a starting rare gas, as described in JP-A-2001-76677 (see Paragraph No. 0005 of the specification and FIG. 5 thereof). The ceramic tube 120 is stable against metal halide, and has a long life, as compared with the glass arc tube.

Naturally, the discharge bulb for use in an automotive headlamp is required to have a good rising characteristic of luminous flux to obtain predetermined luminous flux immediately after the lamp is turned on. This is the same with the discharge bulb having a light emitting tube constituted by a right-circular-cylindrical ceramic tube, which is described in JP '677. This discharge bulb is required to have the ceramic tube, whose diameter is relatively small (whose enclosed space has small capacity), so as to improve the rising characteristic of luminous flux.

However, an arc generated by discharge between the electrodes has an upwardly convex shape. Therefore, as the diameter of the ceramic tube is decreased, the central part of high temperature arc is brought into substantial contact with a tube wall. Thus, the ceramic tube is required to have higher thermal shock resistance. Consequently, very limited ceramic materials are available as the material of the ceramic tube of the light emitting tube.

The related discharge bulb has another problem that when the central part of the high-temperature arc is put into large contact with the tube wall, an amount of heat radiated from the tube wall increases, and this increase in the amount of radiated heat delays the rise in luminous flux. Thus, the rising characteristic of luminous flux is degraded.

SUMMARY OF THE INVENTION

The invention is accomplished in view of the problems of the related discharge bulb. Accordingly, an object of the invention is to provide an automotive discharge bulb enabled to have good rising characteristic of luminous flux and luminous efficiency and to alleviate the required thermal shock resistance of the ceramic tube, and also to provide an automotive headlamp having this discharge bulb.

To achieve the foregoing object, according to the invention, there is provided an automotive discharge bulb (hereunder referred to as a first automotive discharge bulb of the invention) having a light emitting tube that includes a ceramic tube in which paired electrodes are oppositely placed, and that is filled with a light emitting material together with a starting rare gas. In this discharge bulb, a section of the ceramic tube, which is perpendicular to a lengthwise direction thereof, is longitudinally elongated.

The ceramic tube constituting the light emitting tube is required to be compact. Thus, the capacity of an enclosed space of the light emitting tube (that is, the ceramic tube) is small. Immediately after discharging is commenced, the temperature of the enclosed space becomes high. Consequently, the ceramic tube has a good rising characteristic of luminous flux. Also, the surface area of the ceramic tube is small. Thus, a load ($W/cm^2$)imposed on the wall surface increases. Consequently, the ceramic tube has good luminous efficiency.

Although an arc generated by discharge between the electrodes has an upwardly convex shape, the tube wall is not brought into large contact with the high-temperature arc, because the transversal section of the ceramic tube is longitudinally elongated. Consequently, a thermal shock resistance characteristic required of the ceramic tube is alleviated.

Because the tube wall of the ceramic tube is not put into large contact with the high-temperature arc, the amount of heat radiated from the tube wall is reduced. Thus, the enclosed space rapidly reaches a high temperature. Consequently, the rising characteristic of luminous flux is further improved.

According to an embodiment (hereunder referred to a second automotive discharge bulb of the invention) of the first automotive discharge bulb of the invention, the inside diameter of a section of the ceramic tube ranges from about 1 mm to 3 mm. The distance between the electrodes ranges from about 3 mm to 5 mm. The length of a light emitting region of the ceramic tube ranges from about 6 mm to 14 mm, preferably, from about 8 mm to 12 mm.

In consideration of the starting characteristic and the electrical characteristic of an automotive discharge bulb, preferably, the distance between the electrodes is about 3 mm to 5 mm. To prevent the ceramic tube from being broken by thermal shock caused by the contact between an arc, which is generated by discharge between these electrodes into an upward convex shape, and the tube wall thereof, the inside diameter in the longitudinal direction of the transversal section of the ceramic tube is set to be equal to or more than about 1 mm.

When the inside diameter in the longitudinal direction of the transversal section of the ceramic tube exceeds about 3 mm, the surface area of the ceramic tube increases. Thus, the load ($W/cm^2$) imposed on the tube wall is reduced, and the luminous efficiency of the ceramic tube is correspondingly decreased. Also, an image of a light source is enlarged, so that the light distribution characteristic thereof is degraded. Therefore, preferably, the inside diameter in the longitudinal direction of the transversal section of the ceramic tube is equal to or less than 3 mm.

In the case that the length L1 of a light emitting region of the light emitting tube (the ceramic tube) is too short (that is, equal to or less than 6.0 mm), luminous intensity is insufficient in front of a vehicle. Conversely, in the case that the length L1 is too long, the coldest point at the root portions of the electrodes drops. Thus, a luminous flux of 200 lumens or more cannot be obtained. Therefore, the length of the light emitting portion of the light emitting tube (the ceramic tube) ranges from about 6.0 mm to 14.0 mm, preferably, from about 8.0 mm to 12.0 mm.

According to an embodiment (hereunder referred to a third automotive discharge bulb of the invention) of the first or second automotive discharge bulb of the invention, the section of the ceramic tube is shaped nearly like an ellipsoid, whose longitudinal dimension is larger than the widthwise dimension thereof.

The tube wall of the ceramic tube is constituted by a curved surface formed to continuously extend in a circumferential direction. Thermal stress acting upon the ceramic tube in response to the turning-on or turning-off of the discharge bulb is uniformly distributed over the entire tube wall. Thus, thermal stress is not concentrated to a part of the tube wall of the ceramic tube.

According to an embodiment (hereunder referred to a fourth automotive discharge bulb of the invention) of one of the first to third automotive discharge bulbs of the invention, a discharge axis passing through a pair of the electrodes is offset downwardly from the central axis of the section of the ceramic tube.

As compared with a case that the discharge axis coincides with the central axis, the distance between an arc, which is generated by discharge between the electrodes and curved in an upwardly convex manner, and the tube wall is increased in an up ward-downward direction. Thus, even when the longitudinal dimension of the transversal section of the ceramic tube is reduced at least by an increased amount (equivalent to an offset between the discharge axis and the central axis), the arc is not put into large contact with the tube wall. That is,. the dimension of the transversal section of the ceramic tube can be reduced not only in a widthwise direction but in a longitudinal direction.

According to the invention, there is provided an automotive headlamp (hereunder referred to as an exemplary, non-limiting automotive headlamp of the invention) that comprises one of the first to fourth automotive discharge bulbs of the invention, and a latitudinally elongated reflector for frontwardly reflecting light emitted from the light emitting tube.

The recent automotive headlamp has a tendency to use a latitudinally elongated reflector (that is, a reflector whose dimension in a lateral direction is larger than a dimension in an upward-downward direction thereof). Thus, light emitted upwardly and downwardly from the light emitting tube is wastefully consumed. However, the exemplary, non-limiting automotive headlamp of the invention is configured so that the dimension in the widthwise direction of the ceramic tube constituting the light emitting tube is shorter than the dimension in the longitudinal direction thereof. Consequently, the proportion of the wastefully consumed light can be reduced.

DETAILED DESCRIPTION OF THE INVENTION

Next, a mode for carrying out the invention is described hereinbelow according to embodiments of the invention.

Figure 1:
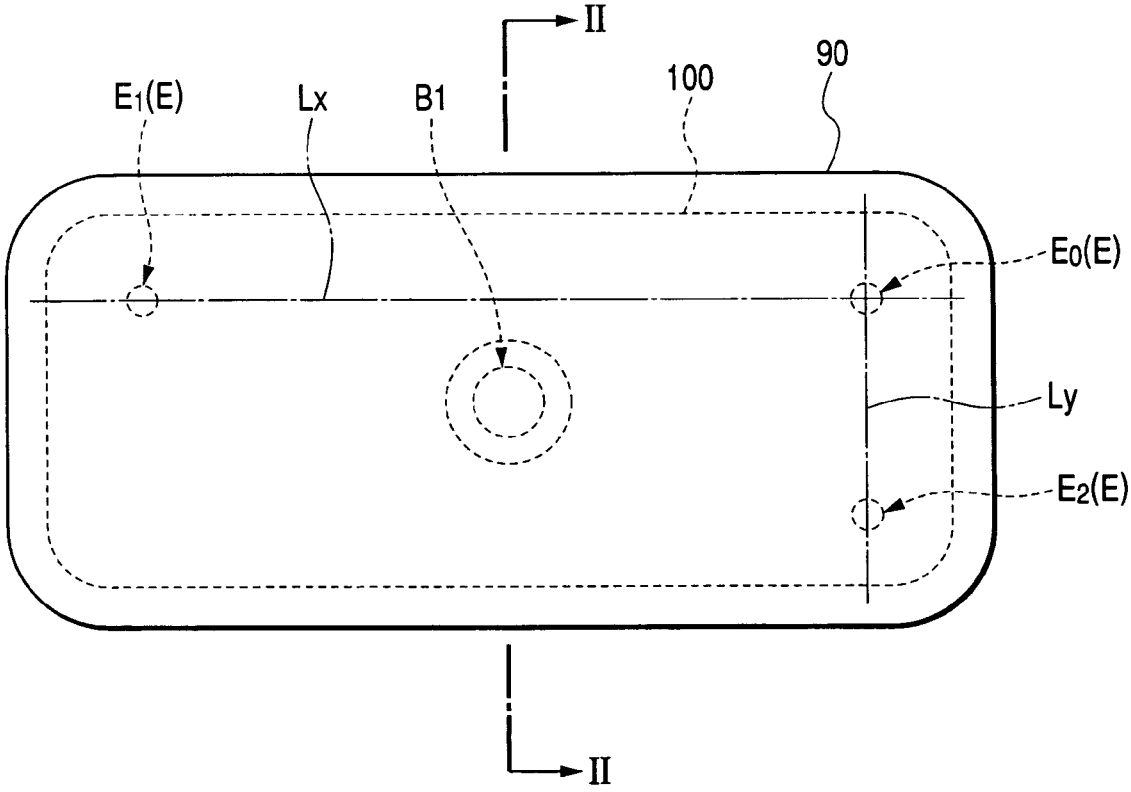
FIG. 1 is a front view illustrating an automotive headlamp in a state wherein a discharge bulb, according to a first exemplary, non-limiting embodiment of the present invention, is inserted into a bulb insertion hole of a reflector.
Figure 2:
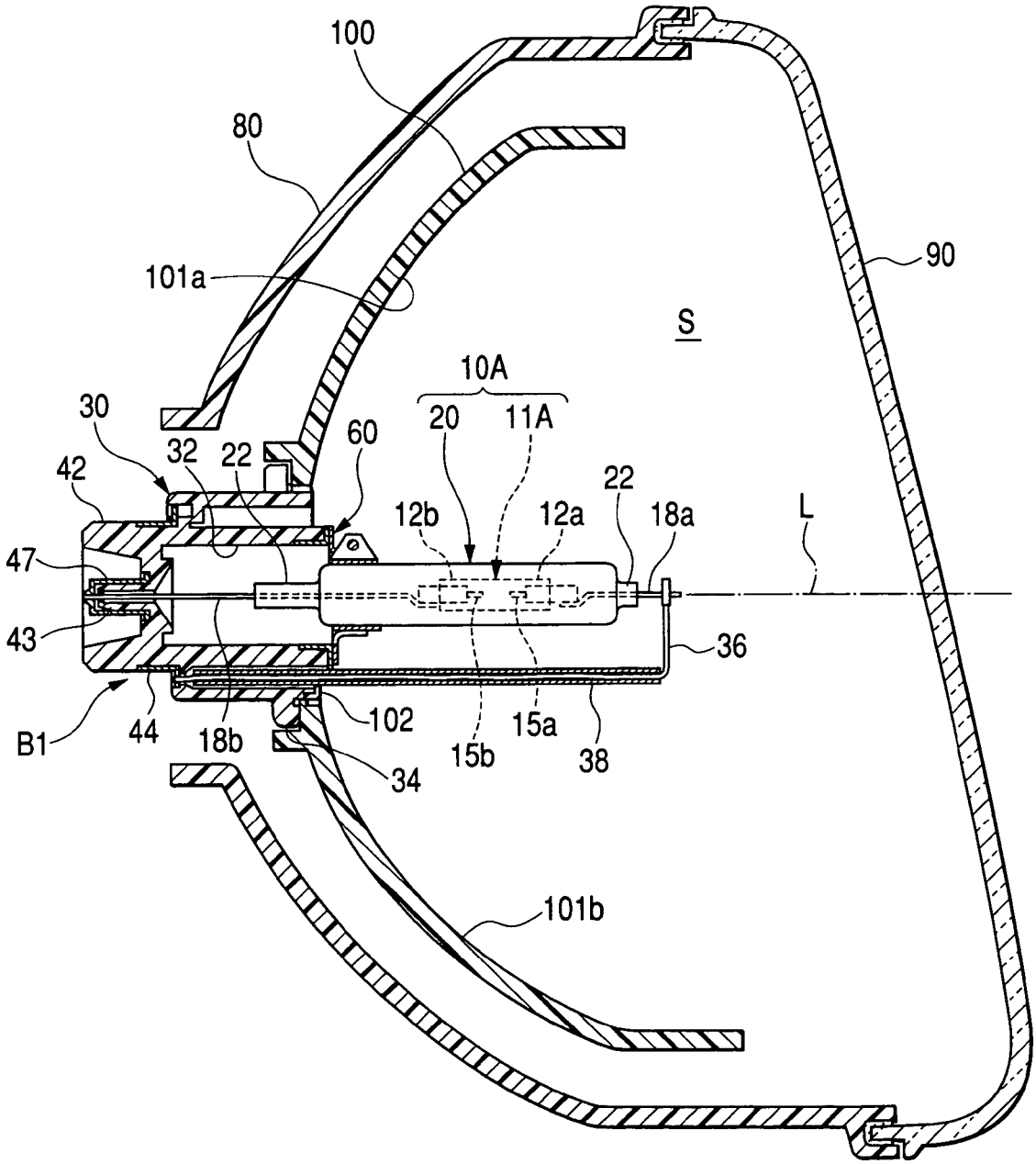
FIG. 2 is a vertically longitudinally sectional view illustrating the headlamp, which is taken along line II—II shown in FIG. 1, according to the first exemplary, non-limiting embodiment of the present invention.
Figure 3:
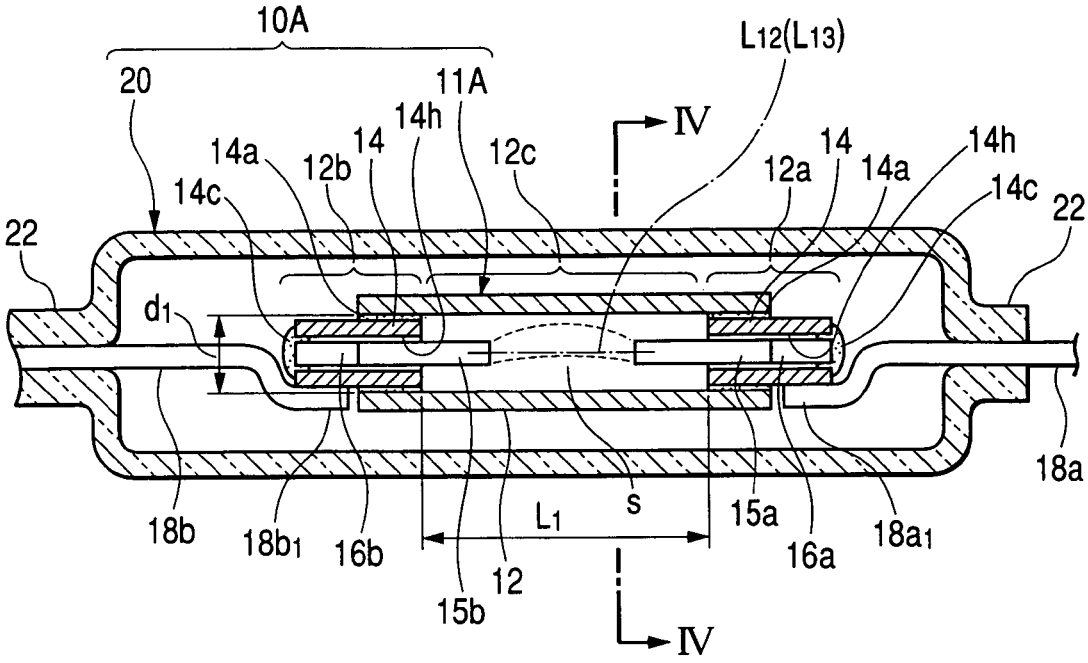
FIG. 3 is an enlarged vertically longitudinally sectional view illustrating an arc tube that is a primary part of the discharge bulb, according to the first exemplary, non-limiting embodiment of the present invention.
Figure 4A:
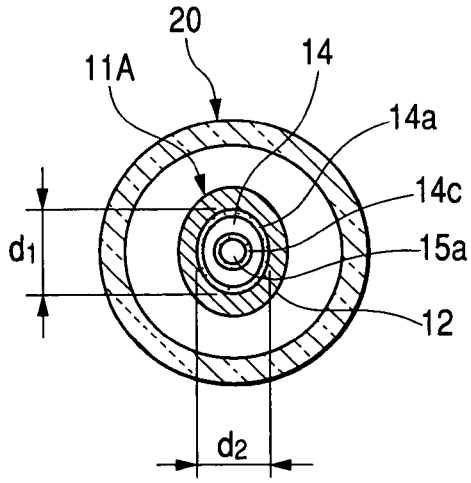
FIGS. 4A and 4B are vertically longitudinally sectional views each illustrating the arc tube, according to the first exemplary, non-limiting embodiment of the present invention, which is taken along line IV—IV shown in FIG. 3.
Figure 4B:
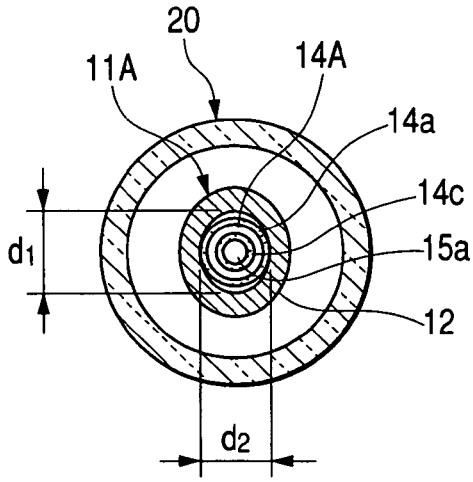
Figure 5:
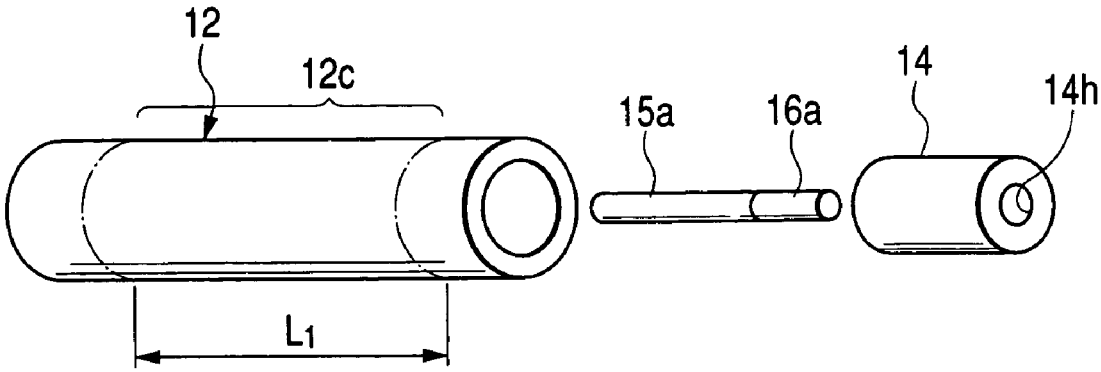
FIG. 5 is an exploded perspective view illustrating a sealed portion of a light emitting tube, according to the first exemplary, non-limiting embodiment of the present invention.
Figure 6:
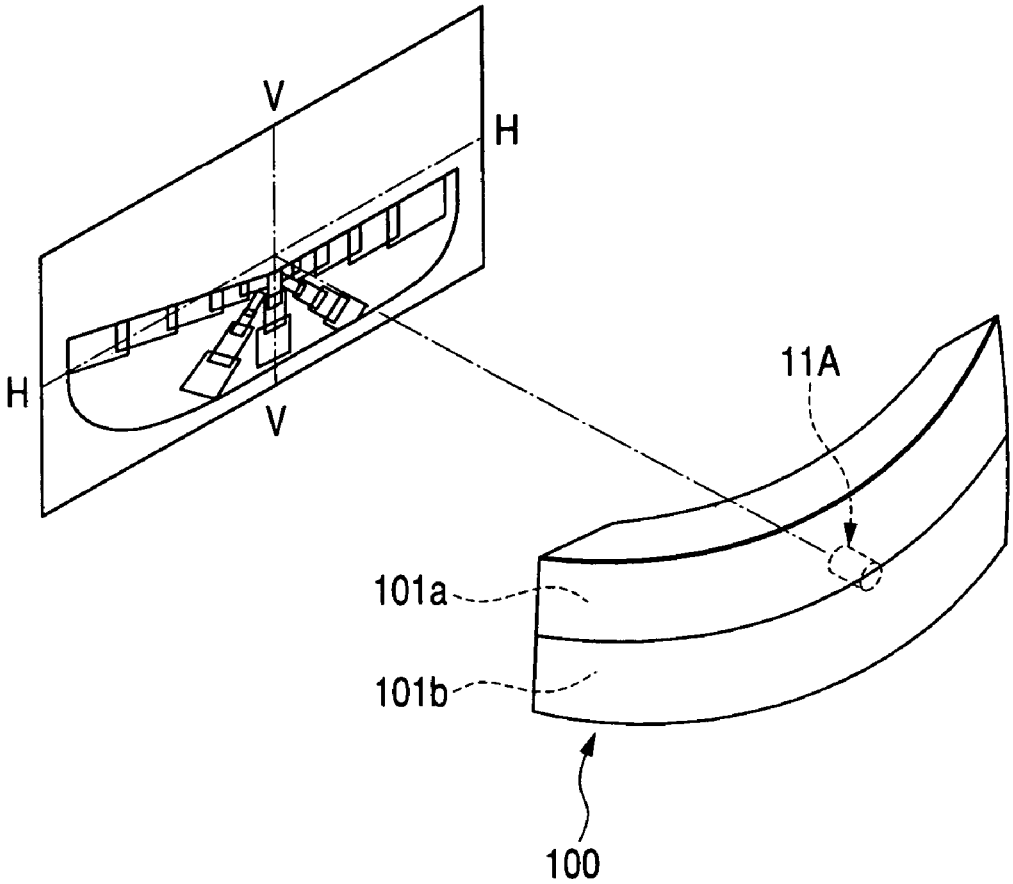
FIG. 6 is a view illustrating an effective reflection surface of the reflector and a light distribution pattern formed on a lighting screen, according to the first exemplary, non-limiting embodiment of the present invention.

FIGS. 1 to 6 show a first exemplary, non-limiting embodiment of the present invention. FIG. 1 is a front view illustrating an automotive headlamp in a state wherein a discharge bulb, which is the first exemplary, non-limiting embodiment, is inserted into a bulb insertion hole of a reflector. FIG. 2 is a vertically longitudinally sectional view illustrating this headlamp, which is taken along line II—II shown in FIG. 1. FIG. 3 is an enlarged vertically longitudinally sectional view illustrating an arc tube that is a primary part of the discharge bulb. FIGS. 4A and 4B are vertically longitudinally sectional views each illustrating the arc tube, which is taken along line IV—IV shown in FIG. 3. FIG. 5 is an exploded perspective view illustrating a sealed portion of a light emitting tube. FIG. 6 is a view illustrating an effective reflection surface of the reflector and a light distribution pattern formed on a lighting screen.

In these figures, reference numeral 80 designates a lamp body of an automotive headlamp, which is shaped like a front-opened container. A lamp chamber S is defined by assembling a front lens (or a front cover in which a step is not formed) 90 to a front opening portion. A reflector 100, in which a discharge bulb B1 is inserted into a bulb insertion hole provided at a rear top, is accommodated in the lamp chamber S. Aluminum evaporated effective reflection surfaces 101*a* and 101*b* are formed in the inside of the reflector 100. Also, a light distribution control step (not shown) is provided therein. Light emitted from the bulb B1 is reflected by the reflector 100 and frontwardly irradiated, so that a predetermined light distribution pattern of the headlamp is formed.

As shown in FIG. 1, an aiming mechanism E consisting of an aiming support E0 of a ball-and-socket coupling structure, and two aiming screws E1 and E2 is interposed between the reflector 100 and the lamp body 80. This embodiment is configured so that the optical axis L of the reflector 100 (and thus, the headlamp) can be tilted (or aiming-adjusted) around a horizontal tilting-movement axis Lx and a vertical titling-movement axis Ly.

Reference numeral 30 denotes a PPS-resin insulating base, in the outer periphery of which a focusing ring 34 engaging the bulb insertion hole 102 of the reflector 100 is provided. An arc tube 10A is fixedly supported in front of this insulating base 30 by a metallic lead support 36, which is a conduction path extended frontwardly from the base 30, and a metallic support member 60 fixed to the front surface of the base 30. Thus, the discharge bulb B1 is constructed.

That is, a lead wire 18*a* drawn from a front end portion of the arc tube 10A is fixed to a bent end portion of the lead support 36 extended from the insulating base 30 by being spot-welded thereto. Thus, the front end portion of the arc tube 10A is supported on the bent end portion of the lead support 36. On the other hand, the lead wire 18*b* drawn from the rear end portion of the arc tube 10A is connected to a terminal 47 provided at the rear end portion of the insulating base 30. Also, the rear end portion of the arc tube 10A is supported on the metallic support member 60, which is fixed to the front surface of the insulating base 30.

A concave portion 32 is provided in the front end portion of the insulating base 30. The rear end portion of the arc tube 10A is accommodated and held in this concave portion 32. A cylindrical boss 43 surrounded by a cylindrical outer cylinder portion 42 extended rearwardly is formed in the rear end portion of the insulating base 30. A cylindrical belt terminal 42 connected to the lead support 36 is integrally fixed to the outer periphery of a root portion of the outer cylindrical portion 42. A cap terminal 47 connected to the rear end side lead wire 18*b* is integrally attached to the boss 43 so as to provide an outer cover thereof.

The arc tube 10A has a structure wherein the light emitting tube 11A having an enclosed space S, in which the paired electrodes 15*a*, 15*b* are oppositely placed, is formed integral with a cylindrical ultraviolet shielding shroud glass 20 covering the light emitting tube 11A. Lead wires 18*a*, 18*b* electrically connected to the electrodes 15*a*, 15*b* projecting into the enclosed space S are drawn from the front and rear end portions of the light emitting tube 11A. These lead wires 18*a*, 18*b* are pinch-sealed or sealed with the ultraviolet shielding shroud glass 20. Thus both the light emitting tube 11A and the shroud glass 20 are integrally formed to thereby construct the arc tube 10A. Reference numeral 22 denotes a pinch-seal portion, whose diameter is reduced, of the shroud glass 20.

As enlargedly shown in FIG. 3, the light emitting tube 11A has a structure wherein both end portions of a ceramic tube 12 having an elliptic transversal section are sealed and wherein the enclosed space S, which contains the paired electrodes 15*a*, 15*b* oppositely placed therein and is filled with light emitting materials (mercury and metal halide) together with a starting rare gas, is provided in the translucent ceramic tube 12. The lead wires 18*a*, 18*b* are respectively connected to the front seal portion 12*a* and the rear seal portion 12*b* of the ceramic tube 12, so that the light emitting tube 11A and the lead wires 18*a*, 18*b* concentrically extend.

Reference numeral 14 designates a molybdenum pipe used for sealing both end opening portions of the ceramic tube 12 and for fixedly holding the electrodes 15*a*, 15*b*. As shown in FIG. 4A, the outside form of the molybdenum pipe 14 is shaped to engage the ceramic tube 12 and to have an elliptical transversal section. A circular hole 14*h*, through which the electrodes are passed, is provided in the central portion thereof. Reference numeral 14*a* denotes a metallized layer for joining the ceramic tube 12 and the molybdenum pipe 14 together and for sealing both end opening portions of the ceramic tube 12. Molybdenum portions 16*a*, 16*b* each having a predetermined length are concentrically and integrally joined to the electrodes 15*a*, 15*b*, respectively. These molybdenum portions 16*a*, 16*b* are welded to the molybdenum pipe 14, so that the electrodes 15*a*, 15*b* are fixed to the ceramic tube 12 through the molybdenum pipe 14. Reference numeral 14*c* is a laser welded portion. The bent end portions 18*a*1, 18*b*1 of the molybdenum lead wires 18*a*, 18*b* are fixed to the molybdenum pipe 14 protruding from the front and rear ends of the ceramic tube 12 by welding. The lead wires 18*a*, 18*b* and the electrodes 15*a*, 15*b* concentrically extend (see FIG. 3).

That is, the molybdenum pipe 14 serving as a blocking member is fixed to both end portions of the ceramic tube 12 by a metallizing joint. The molybdenum portions 16*a*, 16*b* of the electrodes 15*a*, 15*b* are welded to the molybdenum pipe 14. Thus, the seal portions 12*a*, 12*b* of the light emitting tube 11A (the ceramic tube 12) are constructed. Projection portions of the electrodes 15*a*, 15*b*, which protrude into the enclosed space S, are made of tungsten that excels in thermal resistance. Joint portions of the electrodes 15*a*, 15*b*, which are joined to the molybdenum pipe 14, are also made of molybdenum, so that the joint portions and the molybdenum pipe 14 are easily joined together. Thus, this embodiment has both sufficient thermal resistance required of the discharge/light emitting portions of the electrodes 15*a*, 15*b* and sufficient airtightness required of the seal portions of the light emitting tube 11A (the ceramic tube 12).

Incidentally, the joint portions of the ceramic tube 12 and the molybdenum pipe 14 may be configured so that each of molybdenum pipe engaging holes provided in both end opening portions of the ceramic tube 12 is shaped like a perfect circle, as shown in FIG. 4B, and that a molybdenum pipe 14A having a circular transversal section (that is, a perfect circular cylinder shape) is metallization-connected to the ceramic tube 12.

The distance between the electrodes 15*a*, 15*b* is about 3 mm to 5 mm. The transverse section of the ceramic tube 12 is longitudinally elongated so that the inside diameter in the longitudinal direction (the length of a major axis of an ellipsoid that is the transversal section of the ceramic tube) d1 is larger than that in the widthwise direction (the length of a minor axis of the ellipsoid that is the transversal section of the ceramic tube) d2, and that the inside diameter in the longitudinal direction d1 is about 1.0 mm to 3.0 mm. The thickness of the tube wall 12 of the ceramic tube is about 0.4 mm.

In consideration of the starting characteristic and the electrical characteristic of the automotive discharge bulb, preferably, the distance between the electrodes 15*a*, 15*b* is about 3 mm to 5 mm. To prevent the ceramic tube from being broken by thermal shock caused by the contact between an arc, which is generated by discharge between these electrodes 15*a*, 15*b* into an upward convex shape, and the tube wall thereof, the inside diameter in the longitudinal direction of the transversal section of the ceramic tube 12 needs to be set to be equal to or more than about 1 mm.

When the inside diameter in the longitudinal direction of the transversal section of the ceramic tube 12 exceeds about 3 mm, the surface area of the light emitting tube 11A (the ceramic tube 12) increases. Thus, the load (W/cm$^2$) imposed on the tube wall is reduced, and the luminous efficiency of the ceramic tube is correspondingly decreased. Also, an image of a light source is enlarged, so that the light distribution characteristic thereof is degraded. Therefore, preferably, the inside diameter d1 in the longitudinal direction of the transversal section of the ceramic tube 12 ranges from about 1 mm to 3 mm.

A region 12*c* interposed between both end seal portions 12*a*, 12*b* of the light emitting tube 11A is a part serving as the light emitting portion. The length L1 of this light emitting portion region 12*c* is about 8.0 mm to 12.0 mm. A ratio (d1/L1) of the inside diameter d1 in the longitudinal direction thereof to the length L1 ranges from about 0.1 to 0.4. Thus, the light emitting tube is very compact, so that sufficient thermal resistance and durability thereof are ensured, and the entire light emitting portion region 12*c* nearly uniformly emits light. Because the molybdenum pipe 14, the metallized layer 14*a*, and the laser welded portion 14*c* are opaque members, light does not leak out of the end portions (the seal portions 12*a*, 12*b*) of the light emitting tube 11A (the ceramic tube 12). In a stage where the effective reflection surfaces 101*a*, 101*b* are designed, the light emitting portion region 12*c* can be regarded as a rectangular image of a light source. Consequently, the design of the light distribution of the reflector 100 is easily achieved (see FIG. 6).

The ceramic tube 12 is constructed so that the inside diameter d2 in the widthwise direction of a transversal section is about 0.8 mm to 2.7 mm (a ratio (d2/d1) of the inside diameter d2 in the widthwise direction thereof to the inside diameter in the longitudinal direction thereof is about 0.3 to 0.9). Thus, a good rising characteristic of luminous flux and excellent luminous efficiency of the light emitting tube are obtained.

The capacity of an enclosed space of the light emitting tube 11A (the ceramic tube 12) is small. Immediately after discharging starts, the temperature of the enclosed space becomes high. Consequently, the ceramic tube has a good rising characteristic of luminous flux. Also, the surface area of the ceramic tube 12 is small. Thus, a load (W/cm$^2$) imposed on the wall surface increases. Consequently, the ceramic tube 12 has good luminous efficiency.

The central axis L12 of the ceramic tube 12 and the discharge axis L13 passing through the electrodes 15*a*, 15*b* are concentrically provided. Although an arc generated by discharge between the electrodes 15*a*, 15*b* has an upwardly convex shape, the tube wall is not put into large contact with the high-temperature arc, because the transversal section of the ceramic tube 12 is longitudinally elongated (the inside diameter in the longitudinal direction thereof is about 1.0 mm to 3.0 mm). Thus, this embodiment does not have a drawback that high temperature frequently acts on the ceramic tube 12 and causes cracks therein. Consequently, the ceramic tube 12 can stand long-term use.

Because the tube wall is not brought into large contact with the high-temperature arc, the degree of thermal shock resistance required of the ceramic tube 12 of this embodiment is less than that of thermal shock resistance required of the ceramic tube of the related light emitting tube. That is, a thermal shock resistance characteristic required of the ceramic tube 12 is alleviated. Also, the ceramic tube can be constructed by a ceramic material that has hitherto been unable to be used as the material of the ceramic tube.

In the case that the length L1 of a light emitting region 12*c* of the light emitting tube 11A (the ceramic tube 12) is too short (that is, equal to or less than 6.0 mm), luminous intensity is insufficient in front of a vehicle. Conversely, in the case that the length L1 is too long, the coldest point at each of the root portions of the electrodes drops. Thus, a luminous flux of 200 lumens or more cannot be obtained. Meanwhile, a light shielding film for obtaining a predetermined light distribution is sometimes provided on the light emitting tube 11A (the ceramic tube 12). In the case of applying this light shielding film thereto, when the length L1 of the light emitting portion region 12*c* is equal to or less than 6.0 mm, luminous intensity is insufficient. When the length L1 of the light emitting portion region 12*c* is equal to or more than 14.0 mm, an amount of glare light increases. Therefore, the length L1 of the light emitting portion region ranges from 6.0 mm to 14.0 mm, preferably, from 8.0 mm to 12.0 mm.

Metal halide, which is a light emitting material, is filled in the enclosed space S of the ceramic tube 12. Ceramics used as the material of the ceramic tube 12 almost do not react with filler substances, differently from glass. Thus, in the light emitting tube 11A, deterioration with lapse of time, such as devitrification, reduction in the luminous flux, and change in chromaticity, which may occur in the related light emitting tube constituted by a glass tube, can be restrained.

Generally, the luminance and the color of an arc depends on the distance from the arc center. However, the ceramic tube 12 is milkwhite and diffuses emitted light. Thus, when the arc is transmitted by the milkwhite ceramic tube 12, the difference in the luminance and the color can be smoothed. The entire light emitting portion region 12*c* of the light emitting tube 11A (the ceramic tube 12) uniformly emits light, so that light having no irregular luminance and color can be obtained.

The shroud glass 20 covering the light emitting tube 11A (the ceramic tube 12) is constituted by quartz glass that is doped with $TiO_2$, $CeO_2$ or the like and that has effects of light shielding. Thus, the shroud glass 20 substantially eliminates ultraviolet radiation in a predetermined wavelength region, which is harmful to humans, from the light emitted by the light emitting tube 11A.

The inside of the shroud glass 20 is put into vacuum or filled with a nitrogen gas or an inactive gas. The shroud glass 20 is designed to perform heat insulation against heat radiation from the light emitting tube 11A and as to prevent characteristics of the discharge bulb from being affected by change in external environment.

In the light emitting tube 11A, the entire light emitting portion region 12*c* of the light emitting tube 11A (the ceramic tube 12) is caused by an arc, which is generated between the electrodes 15*a*, 15*b*, to emit light. Thus, as illustrated in FIG. 6, the design of light distribution (that is, that of the shapes of the effective reflection surfaces 101*a* and 101*b* of the reflector 100) is performed by regarding the light emitting portion region 12*c* of the light emitting tube 11A (the ceramic tube 12) as a rectangular image of a light source.

As illustrated in FIGS. 1 and 6, the reflector 100 is shaped so that the dimension in the widthwise direction thereof is longer than the dimension in the longitudinal direction thereof. Thus, each of the effective reflection surfaces 101*a* and 101*b* of the reflector 100 is latitudinally elongated. The light distribution of the headlamp is provided mainly by light emitted in the lateral direction from the light emitting tube 11A. Therefore, light emitted in upward and downward directions of the light emitting tube 11A is wastefully consumed. However, in this embodiment, the dimension in the widthwise direction of the transversal section of the light emitting tube 11A (the ceramic tube 12) is set to be shorter than not only the dimension in the longitudinal direction thereof but the diameter of the related perfectly-circular cylindrical ceramic tube. Thus, an amount of light traveling toward the upper and lower noneffective reflection surfaces of the reflector 100 is small. That is, the proportion of the amount of wastefully consumed light to a total amount of light emitted from the light emitting tube 11A is small. Thus, this embodiment has a structure in which light emitted from the light emitting tube 11A is effectively utilized that much.

Figure 7:
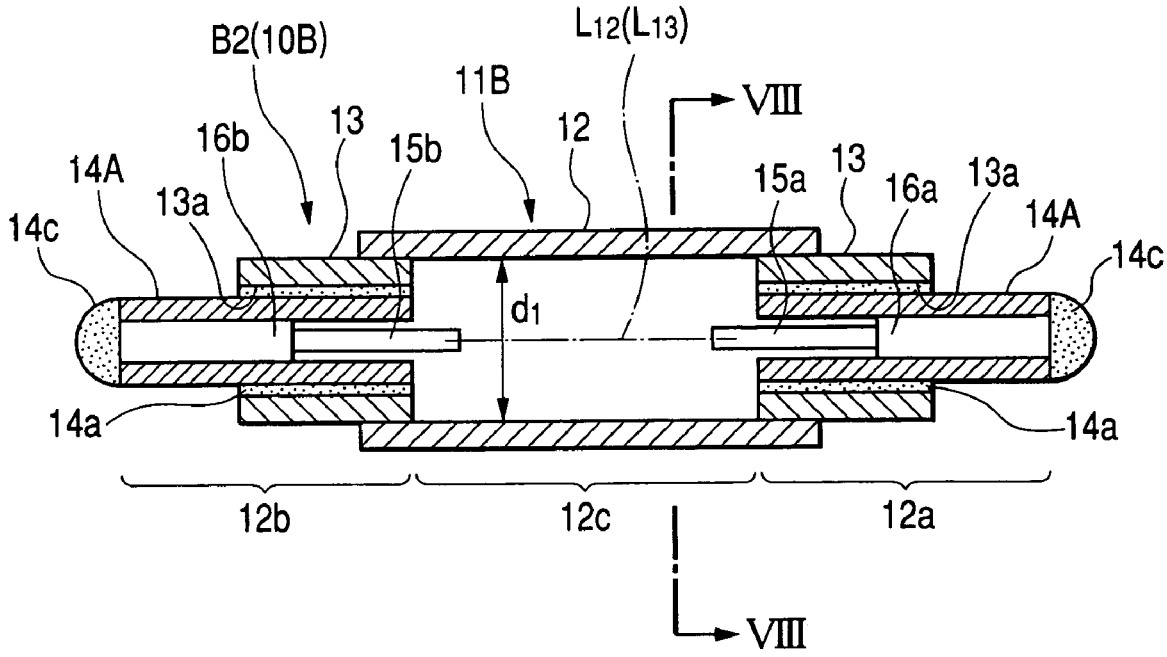
FIG. 7 is a vertically longitudinally sectional view illustrating a light emitting tube, which is a primary part of a discharge bulb that is a second exemplary, non-limiting embodiment of the present invention.
Figure 8:
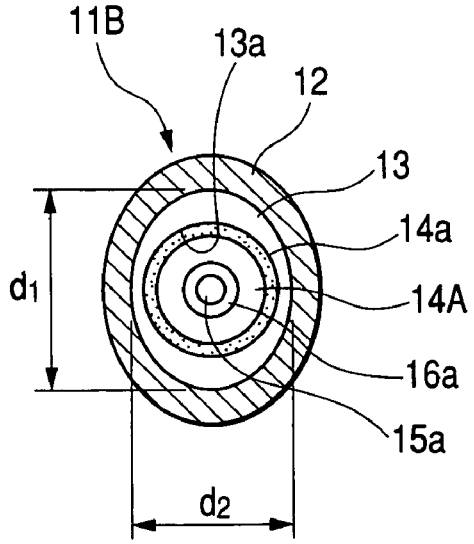
FIG. 8 is a vertically transversally sectional view illustrating the light emitting tube, according to the second exemplary, non-limiting embodiment of the present invention, which is taken along line VIII—VIII shown in FIG. 7.

FIGS. 7 and 8 illustrate a light emitting tube, which is a primary part of a discharge bulb that is a second exemplary, non-limiting embodiment of the present invention. FIG. 7 is a vertically longitudinally sectional view illustrating this light emitting tube. FIG. 8 is a vertically transversally sectional view illustrating this light emitting tube, which is taken along line VIII—VIII shown in FIG. 7.

In the arc tube 10A (the light emitting tube 11A) of the discharge bulb B1 of the first embodiment, the molybdenum pipes 14, 14A, each of which has a elliptic or circular transversal section and is passed through and supports an associated one of the electrodes 15*a*, 15*b*, are metallization-connected to the ceramic tube 12 having an elliptic transversal section. In contrast, in the light emitting tube 11B of the discharge bulb B2 of the second embodiment, ceramic blocking members 13, each of which has an elliptic transversal section (the outer periphery thereof is elliptic and the inner periphery thereof is perfectly circular) are respectively and integrally sintered to both end portions of the ceramic tube 12 whose a longitudinally elliptic transversal section has an inside diameter d1 in the longitudinal direction and an inside diameter d2 in the widthwise direction. A perfectly circularly cylindrical molybdenum pipe 14A is fixed in a circular hole 13*a*, which is formed in a central portion of the transversal section of this blocking member 13, by metallization-connecting.

The remaining components of the second embodiment are the same as corresponding components of the first embodiment, and designated by the same reference characters. Thus, the redundant description of such components is omitted herein.

Figure 9:
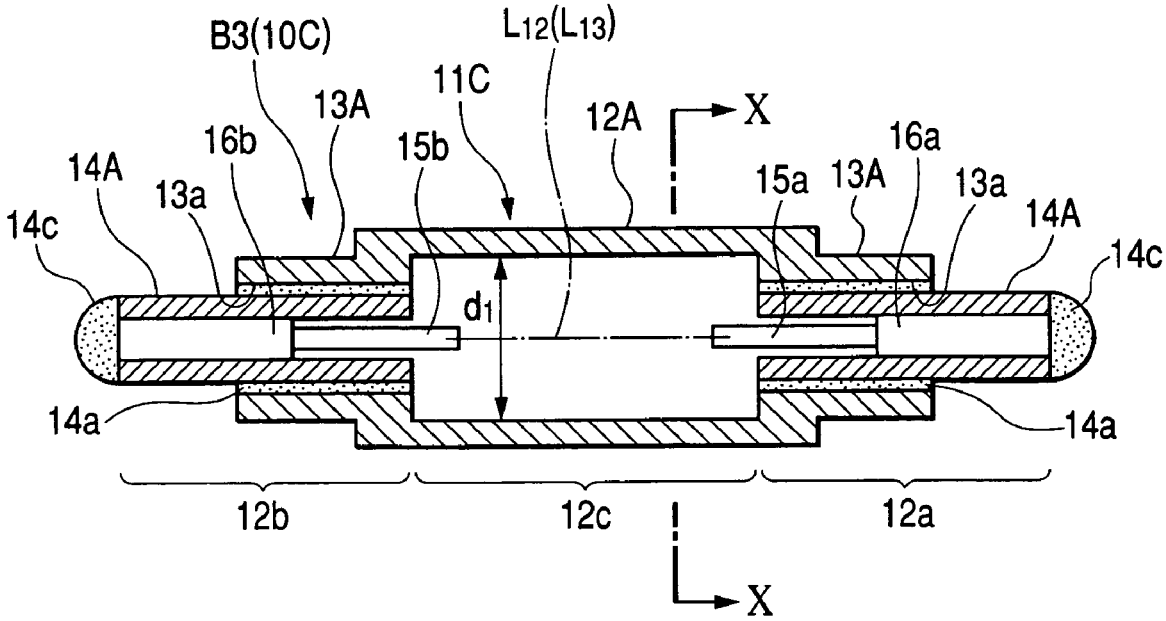
FIG. 9 is a vertically longitudinally sectional view illustrating a light emitting tube, which is a primary part of a discharge bulb that is a third exemplary, non-limiting embodiment of the present invention.
Figure 10:
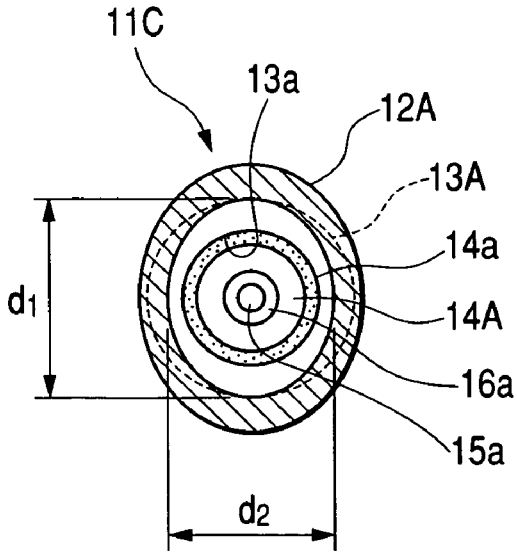
FIG. 10 is a vertically transversally sectional view illustrating the light emitting tube, according to the third exemplary, non-limiting embodiment of the present invention, which is taken along line X—X shown in FIG. 9.

FIGS. 9 and 10 illustrate a light emitting tube, which is a primary part of a discharge bulb that is a third exemplary, non-limiting embodiment of the present invention. FIG. 9 is a vertically longitudinally sectional view illustrating this light emitting tube. FIG. 10 is a vertically transversally sectional view illustrating this light emitting tube, which is taken along line X—X shown in FIG. 9.

In an arc tube 10C (a light emitting tube 11C) of a discharge bulb B3 of this third embodiment, each of the cylindrical blocking members 13 of the second embodiment is integrally formed as apart of the ceramic tube 12. That is, a perfectly circularly cylindrical blocking member 13A provided with a circular hole 13, through which a perfectly circularly cylindrical molybdenum pipe 14 is passed, is formed at each of both end portions of a ceramic tube 12A whose a longitudinally elliptic transversal section has an inside diameter d1 in the longitudinal direction and an inside diameter d2 in the widthwise direction. The remaining components of the third embodiment are the same as corresponding components of the first and second embodiments, and designated by the same reference characters. Thus, the redundant description of such components is omitted herein.

Figure 11:
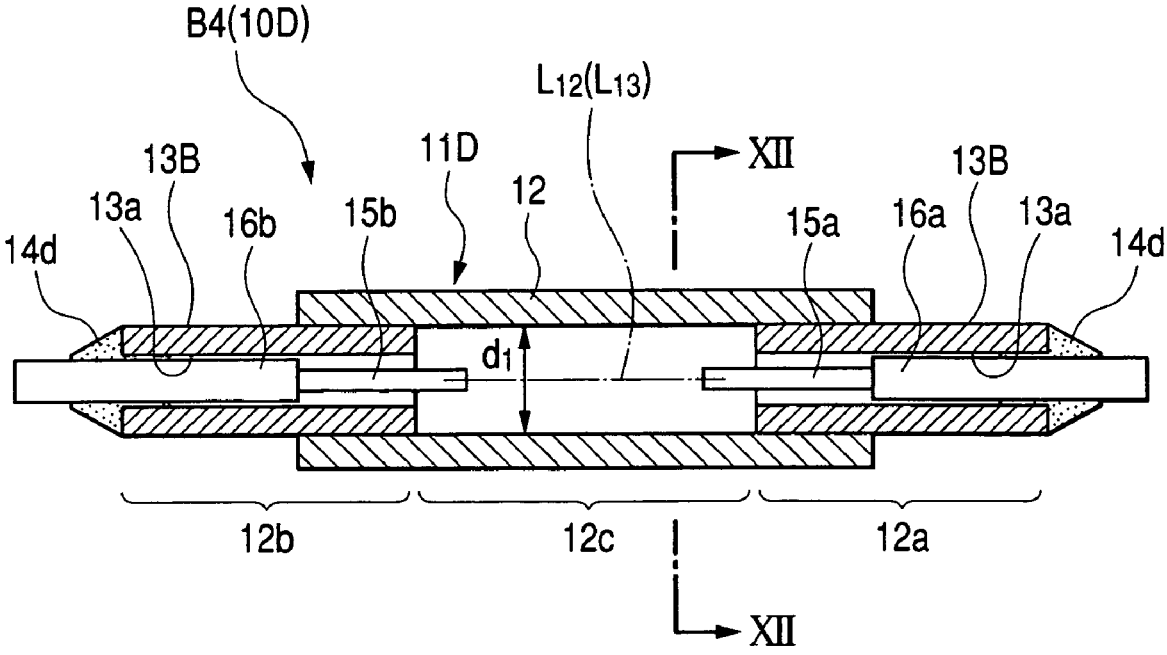
FIG. 11 is a vertically longitudinally sectional view illustrating a light emitting tube, which is a primary part of a discharge bulb that is a fourth exemplary, nonlimiting embodiment of the present invention.
Figure 12:
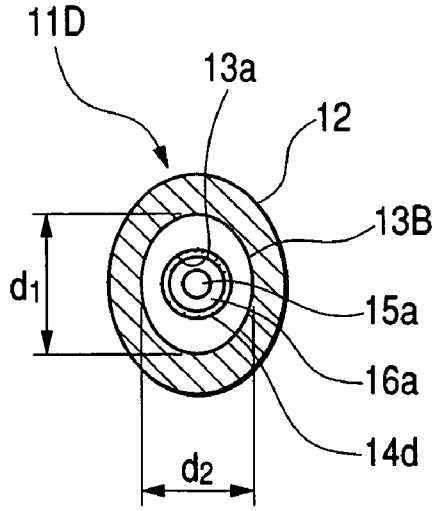
FIG. 12 is a vertically transversally sectional view illustrating the light emitting tube, according to the fourth exemplary, non-limiting embodiment of the present invention, which is taken along line XII—XII shown in FIG. 11.

FIGS. 11 and 12 illustrate a light emitting tube, which is a primary part of a discharge bulb that is a fourth embodiment of the invention. FIG. 11 is a vertically longitudinally sectional view illustrating this light emitting tube. FIG. 12 is a vertically transversally sectional view illustrating this light emitting tube, which is taken along line XII—XII shown in FIG. 11.

In any of the first to third embodiments, the electrodes 15*a*, 15*b* are respectively and integrally joined to the ceramic tubes 12, 12A through the molybdenum pipes 14, 14A. However, in an arc tube 10D (a light emitting tube 11D) of a discharge bulb B4 of this fourth embodiment, the electrodes 15*a*, 15*b* are passed through a circular hole 13*a* of a ceramic blocking member 13B, which has an elliptic transversal section (the outer periphery thereof is elliptic and the inner periphery thereof is perfectly circular) and is integrally sintered to each of both end portions of the ceramic tube 12 having an elliptic transversal section. Also, molybdenum portions 16*a*, 16*b* of the electrodes 15*a*, 15*b*, which outwardly protrude from-the blocking member 13B, are directly and integrally joined to the blocking members 13B, respectively, by glass-melding (that is, sealing). Reference character 14*d* denotes a glass molten portion.

The remaining components of the fourth embodiment are the same as corresponding components of the first to third embodiments, and designated by the same reference characters. Thus, the redundant description of such components is omitted herein.

Figure 13:
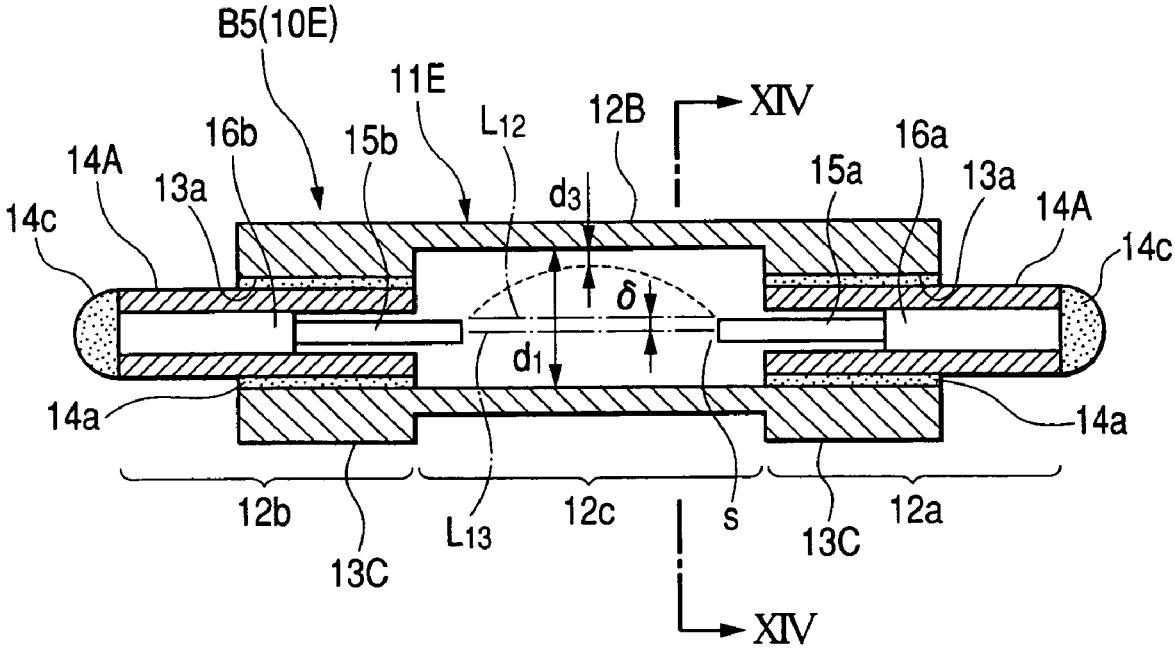
FIG. 13 is a vertically longitudinally sectional view illustrating a light emitting tube, which is a primary part of a discharge bulb that is a fifth exemplary, non-limiting embodiment of the present invention.
Figure 14:
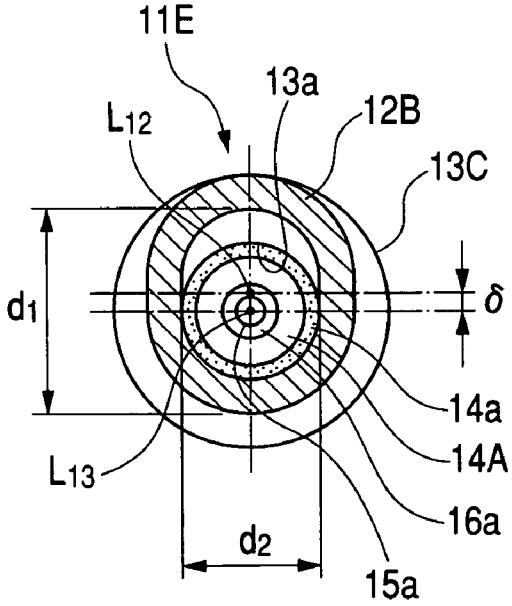
FIG. 14 is a vertically transversally sectional view illustrating the light emitting tube, according to the fifth exemplary, non-limiting embodiment of the present invention, which is taken along line XIV—XIV shown in FIG. 13.
Figure 15:
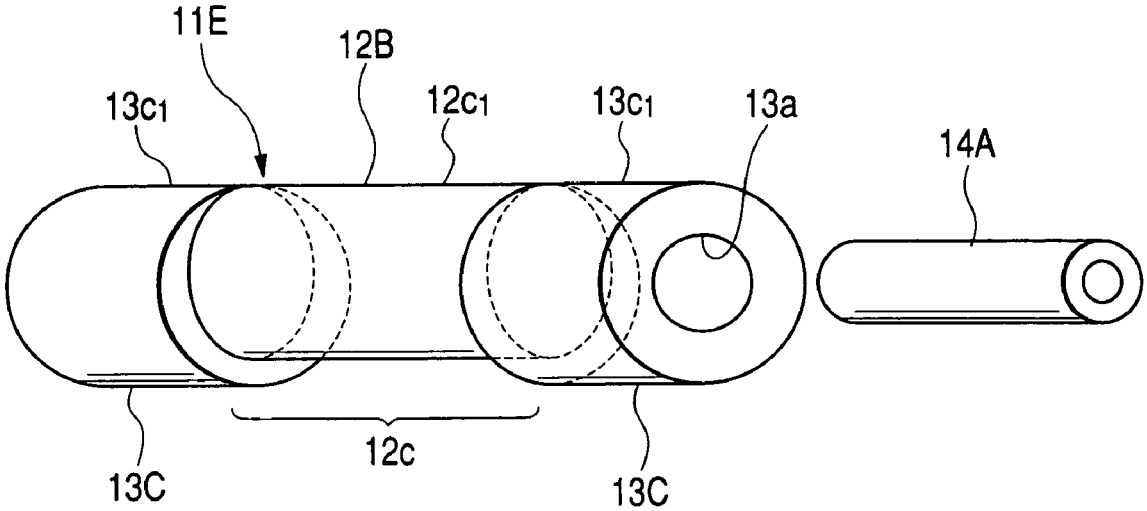
FIG. 15 is a perspective view illustrating this light emitting tube, according to the fifth exemplary, non-limiting embodiment of the present invention.
Figure 16:
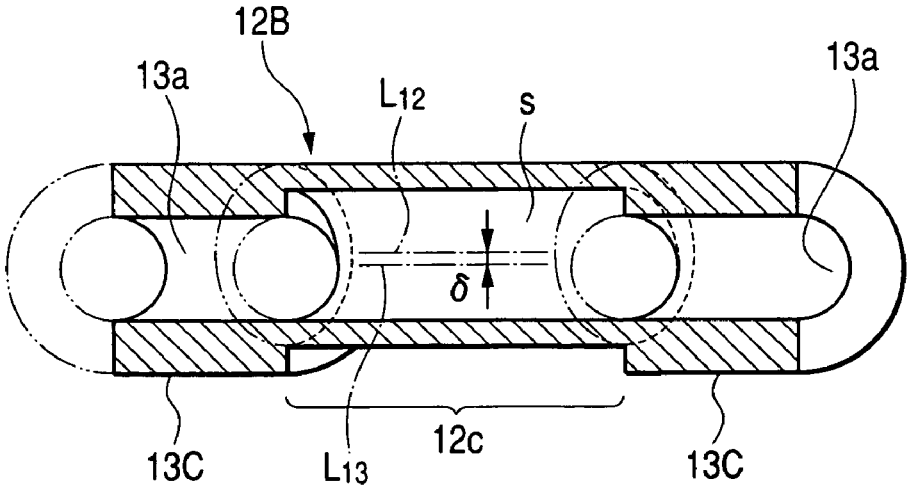
FIG. 16 is an explanatory view illustrating the shape of this light emitting tube, according to the fifth exemplary, non-limiting embodiment of the present invention.

FIGS. 13 to 16 illustrate a light emitting tube, which is a primary part of a discharge bulb that is a fifth embodiment of the invention. FIG. 13 is a vertically longitudinally sectional view illustrating this light emitting tube. FIG. 14 is a vertically transversally sectional view illustrating this light emitting tube, which is taken along line XIV—XIV shown in FIG. 13. FIG. 15 is a perspective view illustrating this light emitting tube. FIG. 16 is an explanatory view illustrating the shape of this light emitting tube.

In an arc tube 10E (a light emitting tube 11E) of a discharge bulb B5 of this fifth embodiment, a ceramic tube 12B is of the type in which the blocking portions and the ceramic tube 12B are integrally formed, and similarly to the third embodiment (see FIGS. 9 and 10). However, the fifth embodiment features a light emitting portion region 12*c*, which has an elliptic transversal section and is adapted to emit light in response to discharge between the electrodes 15*a*, 15*b*, and blocking portions 13C each having a cylindrical shape, a perfectly circularly transversal section and a circular hole 13*a*, through which a molybdenum pipe 14A is inserted, and the ceramic tube 12B are formed in such a manner as to be integral with one another so that the top edges thereof coincide with one another.

That is, the entire ceramic tube 12B including both end blocking portions 13C is substantially cylindrical. The light emitting portion region 12*c* is formed at the central portion in the lengthwise direction of the ceramic tube 12B in such a way as to have an elliptic transversal section whose major axis is shorter than the outside diameter of each of the cylindrical blocking portions 13C. The top edge 12*c*1 of this light emitting portion region 12*c* having the elliptic transversal section, the top edges 13*c*1, 13*c*1 of the two blocking portions, that is, the front and rear blocking portions 13C, 13C each having the circular transversal section constitute a top edge continuously extend in the lengthwise direction of the ceramic tube 12*b* in cooperation with one another.

Thus, a discharge axis L13 passing through the electrodes 15*a*, 15*b* is offset by δ downwardly from the central axis L12 of the enclosed space S, which has an elliptic transversal section and is defined by the light emitting portion region 12*c* of the ceramic tube 12B, (that is, the central axis of the light emitting portion region 12*c* having an elliptic transversal section). Consequently, the distance d3 (see FIG. 13) between an arc, which is generated by discharge between the electrodes 15*a*, 15*b* and upwardly bent in a convex manner, and the tube wall is increased in an upward-downward direction, as compared with that in the case that the discharge axis L13 and the central axis L12 are concentrically arranged. Therefore, the arc is substantially prevented from being brought into large contact with the tube wall of the ceramic tube 12B.

Accordingly, in the case of this embodiment, the distance d3 between the arc and the tube wall is increased. Thus, an amount of heat release from the tube wall is decreased that much. The luminance efficiency of the light emitting portion region 12*c* is substantially enhanced.

Incidentally, in this embodiment, the tube wall is not in contact with the arc even when the inside diameter in the longitudinal direction (that is, the major axis) of the light emitting portion region 12*c* is decreased at least by an amount corresponding to the offset δ between the discharge axis L13 and the central axis L12. Thus, the rising characteristic of luminous flux and the luminous efficiency can be more preferably changed by decreasing the inside diameter d1 in the longitudinal direction (the major axis) of the light emitting portion region 12*c*.

The remaining components of the fifth embodiment are the same as corresponding components of the first embodiment, and designated by the same reference characters. Thus, the redundant description of such components is omitted-herein.

Incidentally, although the discharge axis L13 of the light emitting tube and the central axis L12 of the transversal section of the light emitting portion region are concentrically provided in each of the first to fourth embodiments, the discharge axis L13 may be offset by δ downwardly from the central axis L12 of the light emitting portion region 12*c* therein, similarly to the fifth embodiment.

Figure 17A:
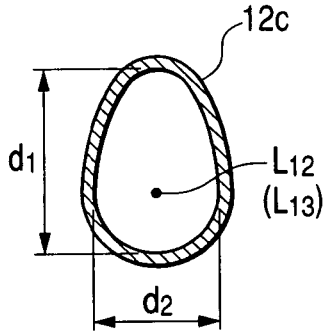
FIG. 17A is a vertically transversally sectional view illustrating (a light emitting region of) a ceramic tube constituting a light emitting tube, which is a primary part of a discharge bulb that is another exemplary, non-limiting embodiment of the present invention.
Figure 17B:
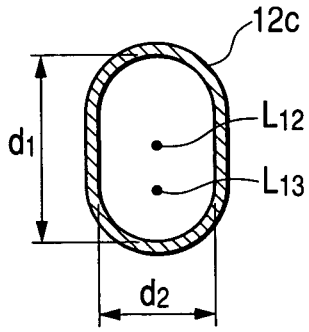
FIG. 17B is a vertically transversally sectional view illustrating (a light emitting region of) a ceramic tube constituting a light emitting tube, which is a primary part of a discharge bulb that is still another exemplary, non-limiting embodiment of the present invention.
Figure 17C:
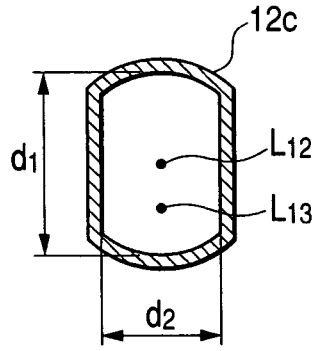
FIG. 17C is a vertically transversally sectional view illustrating (a light emitting region of) a ceramic tube constituting a light emitting tube, which is a primary part of a discharge bulb that is yet another exemplary, non-limiting embodiment of the present invention.
Figure 18:
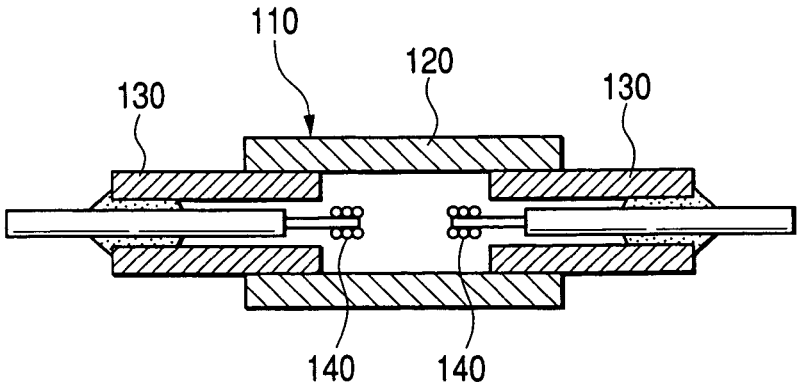
FIG. 18 is a vertically longitudinally sectional view illustrating a related art light emitting tube constituted by a ceramic tube.

Although the foregoing description of the first to fifth embodiments has described the case that at least a transversal section of the light emitting portion region 12*c* of the ceramic tube is longitudinally elliptic, the shape of the transversal section of the light emitting portion region is not limited to an ellipsoid. For example, but not by way of limitation, the transversal section thereof may have another non-circular shape, such as (but not limited to) an egg-like shape, an oval shape, and the combined shape of vertical and round walls, as shown in FIGS. 17A, 17B, and 17C, respectively. Incidentally, in FIGS. 17A, 17B, and 17C, reference character L12 designates the central axis of the light emitting portion region of the ceramic tube. Reference character L13 denotes a discharge axis of the light emitting tube.

In the foregoing description, it has been described that the discharge bulb according to each of the various embodiments has the arc tubes which is obtained by integrally forming the light emitting tube and the shroud glass surrounding this light emitting tube, in front of the base 30. However, the arc tube to be disposed frontwardly from the base 30 may have a structure in which only the light emitting tube is provided without providing the shroud glass therein.

The present invention has various advantages, but does not need to have these advantages. As is apparent from the foregoing description, the first automotive discharge bulb of the invention can obtain a good rising characteristic of luminous flux and good luminous efficiency. Also, a discharge bulb with no concerns about thermal shock resistance of the ceramic tube can be obtained.

Moreover, the thermal shock resistance to the extent hitherto required of the related ceramic tube is not required of the ceramic tube of the first automotive discharge bulb of the invention. Consequently, a ceramic tube constructed through the use of a ceramic material having hitherto been unavailable can be utilized. Thus, the choice of ceramic materials available for the ceramic tube is increased. Hence, discharge bulbs having various light emitting characteristics can be provided at low cost.

According to the second automotive discharge bulb of the invention, there are provided discharge bulbs that excel in the rising characteristic of luminous flux, the luminous efficiency, and the thermal shock resistance.

According to the third automotive discharge bulb of the invention, thermal stress associated with turning-on and turning-off of the discharge bulb is not concentrated to a part of the tube wall of the ceramic tube. Thus, a discharge bulb, whose durability is ensured over a long period, can be obtained.

According to the fourth automotive discharge bulb of the invention, the transversal section of the ceramic tube can be reduced in dimension not only in a widthwise direction but in a longitudinal direction. The capacity of the enclosed space in the ceramic tube and the surface area thereof are reduced still more. Thus, the rising characteristic of luminous flux and the luminous efficiency become more favorable.

According to the exemplary, non-limiting automotive headlamp of the invention, the proportion of wastefully consumed upward and downward light is decreased. Thus, an automotive headlamp effectively utilizing light emitted from the light emitting tube that much can be obtained.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. An automotive discharge bulb comprising:

a light emitting tube that includes a ceramic tube in which paired electrodes are oppositely placed, wherein said ceramic tube is filled with a light emitting material and a starting rare gas, and a section of said ceramic tube perpendicular to a lengthwise direction thereof is longitudinally elongated, and wherein an inside diameter of a section of said ceramic tube ranges from about 1 mm to 3 mm, a distance between said electrodes ranges from about 3 mm to 5 mm, and a length of a light emitting region of said ceramic tube ranges from about 6 mm to 14 mm.

2. The automotive discharge bulb of claim 1, wherein said length of said light emitting region ranges from about 8 mm to 12 mm.

3. The automotive discharge bulb according to claim 1, wherein said section of said ceramic tube is substantially ellipsoid in shape and has a longitudinal dimension larger than a widthwise dimension thereof.

4. The automotive discharge bulb according to claim 1, wherein a discharge axis passing through a pair of said electrodes is offset downwardly from a central axis of said section of said ceramic tube.

* * * * *